US009126421B1

(12) United States Patent
Mochida

(10) Patent No.: US 9,126,421 B1
(45) Date of Patent: Sep. 8, 2015

(54) THERMAL PRINTER, RIBBON SAVING METHOD AND RIBBON SAVING PROGRAM

(71) Applicant: TOSHIBA TEC KABUSHIKI KAISHA, Shinagawa-ku, Tokyo (JP)

(72) Inventor: Sadayoshi Mochida, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/180,474

(22) Filed: Feb. 14, 2014

(51) Int. Cl.
*B41J 2/165* (2006.01)
*B41J 2/325* (2006.01)

(52) U.S. Cl.
CPC ..... *B41J 2/325* (2013.01)

(58) Field of Classification Search
None
See application file for complete search history.

(56) References Cited

FOREIGN PATENT DOCUMENTS

| | | |
|---|---|---|
| JP | 07-089106 | 4/1995 |
| JP | 2958769 | 10/1999 |

*Primary Examiner* — Alejandro Valencia
(74) *Attorney, Agent, or Firm* — Amin, Turocy & Watson, LLP

(57) ABSTRACT

Generally, in accordance with one embodiment, a thermal printer comprises a thermal head configured to press a transfer ribbon conveyed along with a sheet towards the sheet and endows the transfer ribbon with heat to transfer the ink of the transfer ribbon to the sheet; a head moving mechanism configured to lift the thermal head to an unprintable position separating from the sheet side and lower the thermal head to a printable position where the transfer ribbon is pressed to the sheet; and a controller configured to acquire a set value of printing speed, carry out printing process while conveying the sheet at the printing speed in a printing area, change the sheet conveyance speed to a speed lower than the set value in a non-print area, and lift and lower the thermal head while conveying the sheet at the lower speed.

9 Claims, 7 Drawing Sheets

821

| CONVEYANCE SPEED(mm/s) | LENGTH OF NON-PRINT AREA (mm) |
|---|---|
| 3 | 20 |
| 6 | 25 |
| 8 | 35 |
| 10 | 50 |
| 12 | 63 |
| 14 | 80 |

FIG.4

821

| CONVEYANCE SPEED(mm/s) | LENGTH OF NON-PRINT AREA (mm) |
|---|---|
| 3 | 20 |
| 6 | 25 |
| 8 | 35 |
| 10 | 50 |
| 12 | 63 |
| 14 | 80 |

THERMAL PRINTER, RIBBON SAVING METHOD AND RIBBON SAVING PROGRAM

FIELD

Embodiments described herein relate to a technology for saving the ribbon of a thermal printer.

BACKGROUND

A thermal printer is known which melts the ink of a transfer ribbon with the heat generating element of a thermal head and transfers the ink on a sheet. The thermal printer conveys the transfer ribbon and the sheet at the same speed and presses, through the thermal head, the transfer ribbon to contact the sheet. In this state, by means of the thermal head, the thermal printer prints on the sheet via the transfer ribbon.

Thermal printers include a printer having a ribbon saving mode, in which the printer stops the conveyance of a transfer ribbon and merely conveys a sheet in a non-print area if the length of the non-print area in a conveyance direction is above a given value, wherein the length of the non-print area is contained in printing data. Further, the printer carries out lifting the thermal head for separating the transfer ribbon from the sheet by means of separating the thermal head from the side of the sheet. In this way, the consumption of the transfer ribbon in the non-print area is restricted in the ribbon saving mode.

Before conveying a sheet to the part of the non-print area, the printer carries out the lifting to make the thermal head return to the former printable position and restarts the conveyance of the transfer ribbon.

However, during a ribbon saving processing which includes lifting the thermal head and lowering the thermal head, a mechanical operation such as lowering the thermal head is needed. In order to guarantee a time for the operation, it is needed to make a given length of non-print area in printing data when carrying out a ribbon saving processing. The necessary length of non-print area increases in proportion to a printing speed (a sheet conveyance speed).

Thus, it may happen in the case of a set high printing speed that the ribbon saving processing is unachievable if the length of non-print area is smaller than a necessary value.

BRIEF DESCRIPTION OF THE DRAWINGS

FIG. 4 is a diagram illustrating a table in a ROM;

DETAILED DESCRIPTION

Generally, in accordance with embodiments, a thermal printer comprises a thermal head, a head moving mechanism and a controller. The thermal head presses a transfer ribbon conveyed along with a sheet towards the sheet and endows the transfer ribbon with heat to transfer the ink of the transfer ribbon to the sheet. The head moving mechanism lifts the thermal head to an unprintable position which separates from the sheet side and lowers the thermal head to a printable position in which the transfer ribbon is pressed on the sheet. The controller acquires a set value of printing speed, carries out printing on the sheet while conveying the sheet at the printing speed in a printing area, changes the conveyance speed of the sheet to a speed lower than the set value in a non-print area, and lifts and lowers the thermal head while conveying the sheet at the smaller speed.

Generally, in accordance with embodiments, a ribbon saving method is a ribbon saving method for a thermal printer comprising a thermal head configured to press a transfer ribbon conveyed along with a sheet towards the sheet and endow the transfer ribbon with heat to transfer the ink of the transfer ribbon to the sheet; and a head moving mechanism configured to lift the thermal head to an unprintable position separating from the sheet side and lower the thermal head to a printable position where the transfer ribbon is pressed to the sheet; the transfer ribbon saving method including: acquiring a set value of a printing speed, carrying out printing process while conveying the sheet at the printing speed in a printing area, changing the sheet conveyance speed to a speed lower than the set value in a non-print area, and lifting and lowering the thermal head while conveying the sheet at the lower speed.

Embodiments of the present invention are described below with reference to accompanying drawings.

Figure 1:
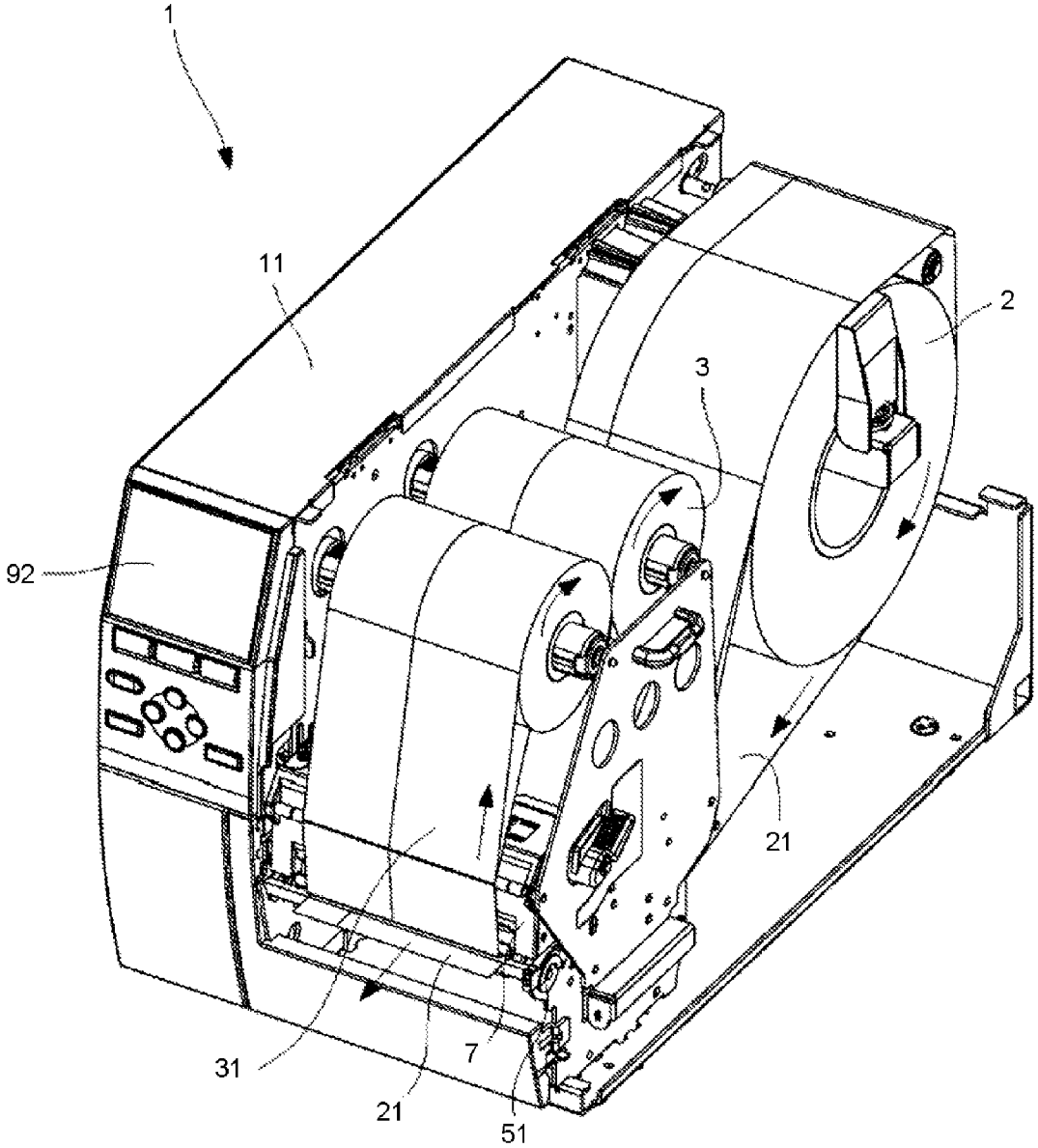
FIG. 1 is a perspective view illustrating the internal of a thermal printer.

FIG. 1 is a perspective view illustrating the internal of a thermal printer 1 (hereinafter referred to as a printer 1).

The printer 1 conveys a label sheet 21 the backing paper of which is affixed with a plurality of labels along with a transfer ribbon 31 to the space between a thermal head 4 (FIG. 2) in a head moving mechanism 7 and a platen roller 51. By means of the thermal head 4, the printer 1 prints on each label on the label sheet 21 with the transfer ribbon 31. The printer 1 prints commodity names, prices and barcodes on each label based on the printing data and the like received from an external terminal.

A display 92 is arranged on the front of the frame 11 of the printer 1.

A label sheet roller 2 on which the label sheet 21 is rolled and a transfer ribbon roller 3 on which the transfer ribbon 31 is rolled are arranged in the internal of frame 11 of the printer 1.

Figure 2:
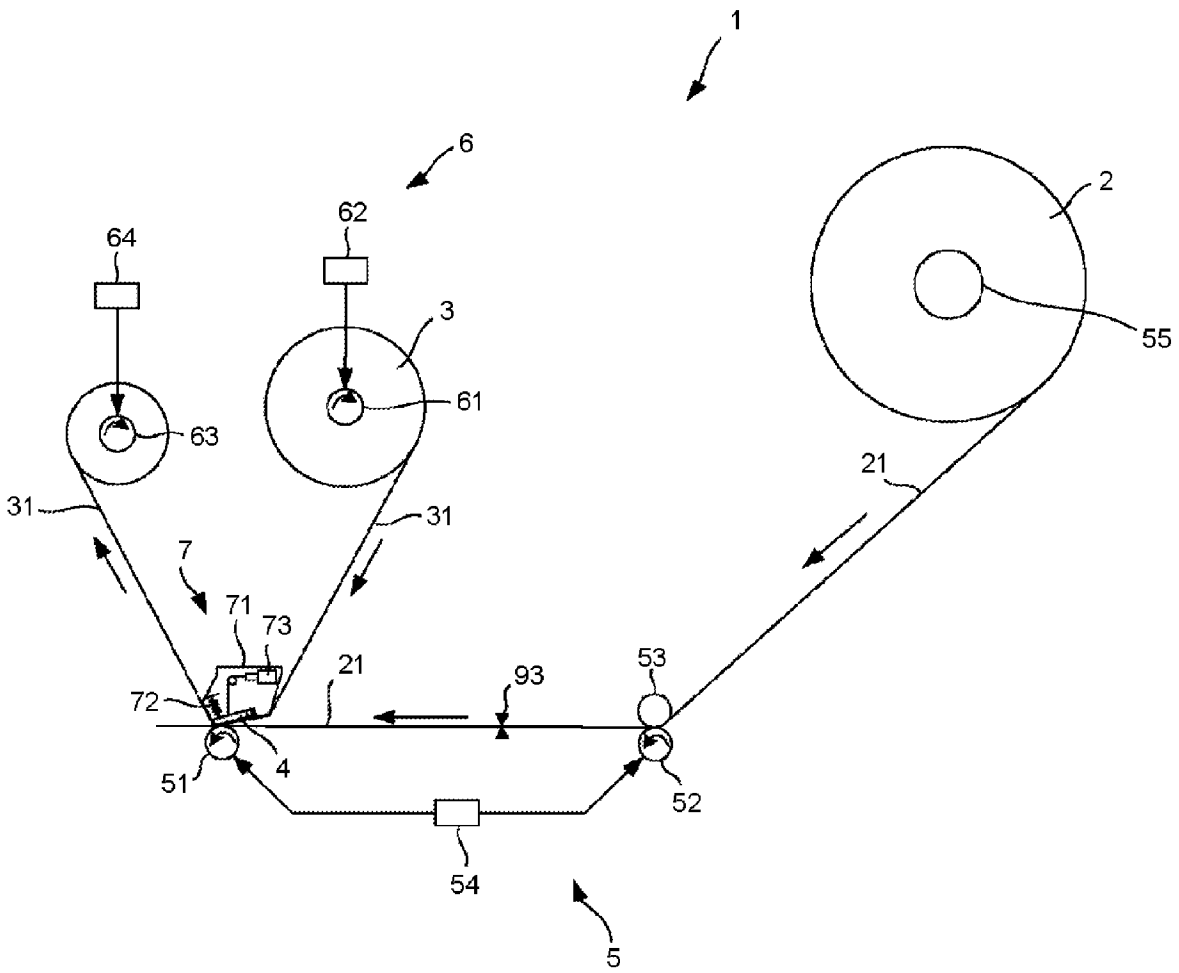
FIG. 2 is a schematic diagram illustrating the internal configuration of a thermal printer.

FIG. 2 is a schematic diagram illustrating the internal configuration of the thermal printer 1.

In addition to the aforementioned elements, a sheet conveyance mechanism 5, a ribbon conveyance mechanism 6 and a sheet sensor 93 are also arranged in the printer 1. Each element of the printer 1 is briefly described below.

The sheet conveyance mechanism 5 which conveys the label sheet 21 to the space between the thermal head 4 and the platen roller 51 comprises the platen roller 51, a conveyance roller 52, a driven roller 53, a stepping motor 54 and a holding section 55.

The platen roller 51 is opposite to the thermal head 4. When the thermal head 4 is in the printable head-down state shown in FIG. 2, the platen roller 51 conveys the label sheet 21 and compresses the transfer ribbon 31 and the label sheet 21 with the thermal head 4.

The conveyance roller 52 located further upstream than the platen roller 51 in the conveyance direction of the label sheet 21 conveys the label sheet 21 to a downstream side. When the thermal head 4 retreated upward to be in an unprintable head-up state, the conveyance roller 52 mainly conveys the label sheet 21.

The driven roller 53 clamps the label sheet 21 with the conveyance roller 52 and is rotated under the drive of the movement of the label sheet 21.

The stepping motor 54 drives the platen roller 51 and the conveyance roller 52 with a drive force transmission unit such as a belt. A CPU 81 (shown in FIG. 3) which will be described later masters the position of the label sheet 21 based on the drive steps of the stepping motor 54 and an output signal of the sheet sensor 93 which will be described later.

The holding section 55 rotatably holds the label sheet roller 2.

The ribbon conveyance mechanism 6 conveys the transfer ribbon 31 to the space between the thermal head 4 and the platen roller 51. The ribbon conveyance mechanism 6 conveys the transfer ribbon 31 at a speed equal to the conveyance speed of the sheet according to the sheet conveyance mechanism 5. The ribbon conveyance mechanism 6 comprises a supply shaft 61, a back ribbon motor 62, a winding shaft 63 and a front ribbon motor 64.

The supply shaft 61 is provided with a transfer ribbon roller 3 and rotates the transfer ribbon roller 3 to convey the transfer ribbon 31 to the space between the thermal head 4 and the platen roller 51.

The back ribbon motor 62 rotates the supply shaft 61.

The winding shaft 63 winds the transfer ribbon 31.

The front ribbon motor 64 rotates the winding shaft 63.

Ink is laminated on the substrate of the transfer ribbon 31.

The thermal head 4 has a plurality of heat generating elements arranged along the width direction of the label sheet 21 in the lower surfaces. The thermal head 4, when contacted with the transfer ribbon 31 under pressure, selectively enables the heat generating elements to generate heat under an instruction from the CPU 81 and adds the heat to the transfer ribbon 31 with the heat generating elements. The thermal head 4 melts or sublimates the ink of the transfer ribbon 31 to transfer the ink on the label sheet 21, thereby printing an image on the label sheet 21.

The head moving mechanism 7 lifts the thermal head 4. Lifting the thermal head refers to moving the thermal head 4 at a printable position shown in FIG. 2 where the transfer ribbon 31 is pressed to the sheet to an unprintable position, the up direction shown in FIG. 2 separating from the side of the label sheet 21. The head moving mechanism 7 lowers the thermal head 4. Lowering the thermal head refers to moving the thermal head 4 at the unprintable position to the down direction shown in FIG. 2, a printable position where the transfer ribbon 31 is pressed to the label sheet 21.

The head moving mechanism 7 comprises a guide frame 71, a spring 72 and a solenoid 73.

The guide frame 71 guides the transfer ribbon 31 to the space between the thermal head 4 and the platen roller 51. The guide frame 71 houses the thermal head 4, the spring 72 and the solenoid 73 therein. The guide frame 71 rotatably holds one end of the thermal head 4. An opening section is arranged on the lower of the guide frame 71. The thermal head 4 is contacted with the transfer ribbon 31 via the opening section under pressure.

The spring 72 energizes the other end side of the thermal head 4 to the platen roller 51.

When turned on, the solenoid 73 against the energization force of the spring 72 to lift the other end side of the thermal head 4 to lift the thermal head 4. When turned off, the solenoid 73 relieves the lifting of the other end side of the thermal head 4 to lower the thermal head 4.

The sheet sensor 93 is a transmission-type sensor which is located further upstream than the thermal head 4. The sheet sensor 93 detects the distal end position of the label on the label sheet 21.

Figure 3:
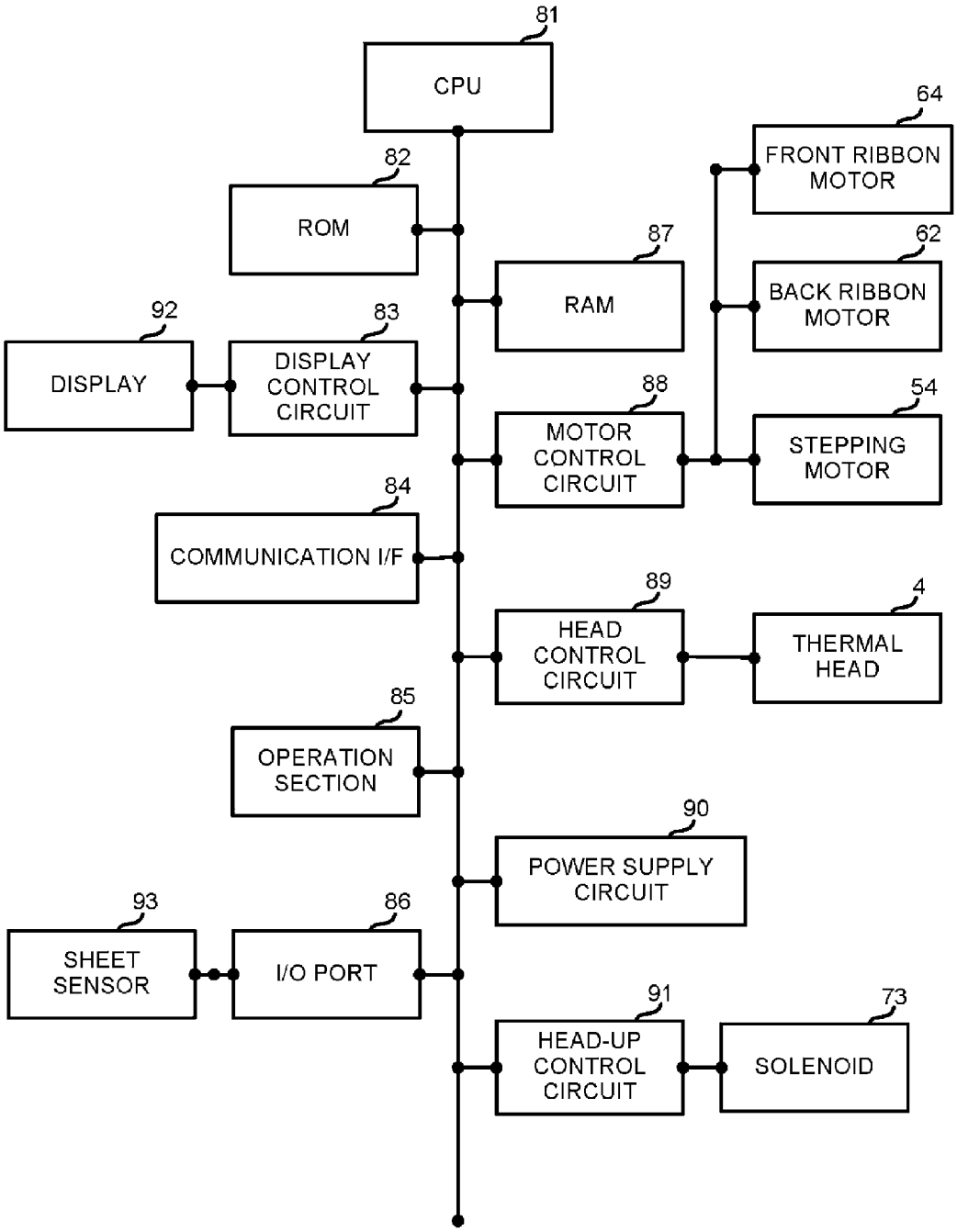
FIG. 3 is a block diagram illustrating the configuration of a thermal printer.

FIG. 3 is a block diagram illustrating the configuration of the printer 1.

The CPU 81 (Central Processing Unit) 81 serving as a controller realizes various functions by executing the programs stored in the ROM 82. The ROM 82 (Read Only Memory) stores various control programs. A RAM (Random Access Memory) 87 provides a temporary work area for the CPU 81. A display control circuit 83 controls the display 92 according to an instruction of the CPU 81. A communication I/F 84 receives printing data from an external terminal such as a PC (Personal Computer). An operation section 85 comprising operation keys and a touch panel accepts the set input such as a printing starting instruction, a printing speed from a user. An I/O (Input/Output) port 86 inputs a signal from the sheet sensor 93 to the CPU 81. A motor control circuit 88 controls motors 54, 62 and 64 according to an instruction of the CPU 81. A head control circuit 89 controls the thermal head 4 according to an instruction of the CPU 81. A power supply circuit 90 controls the power supply for each element. A head-up control circuit 91 turns on and turns off the solenoid 73 according to an instruction of the CPU 81 and lifts and lowers the thermal head 4.

The CPU 81 can set a printing speed (the conveyance speed of the transfer ribbon 31 and the label sheet 21) to be 3, 6, 8, 10, 12, 14 (mm/sec). The CPU 81 receives, from an external terminal, printing data including set values of printing speed and sets a printing speed. The CPU 81 may also accept the setting on a printing speed from the printer 1.

Figure 5:
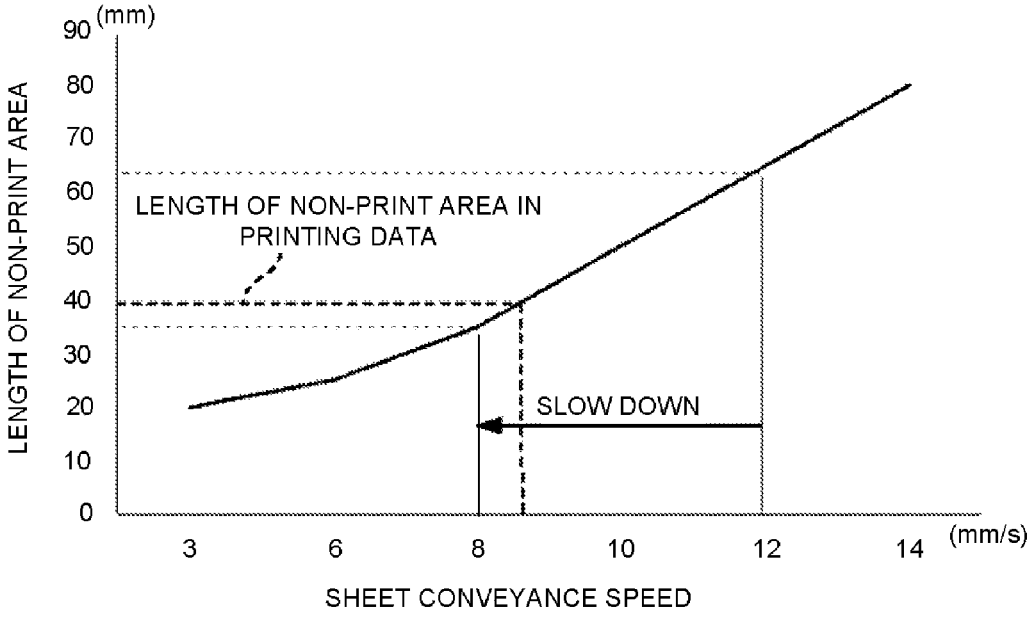
FIG. 5 is a graph illustrating the relationship between a printing speed and a necessary length of non-print area.

FIG. 4 is a diagram illustrating a table 821 in the ROM 82. FIG. 5 is a graph illustrating the relationship between the sheet conveyance speed and the necessary length of non-print area shown in table 821, the abscissa represents a sheet conveyance speed (mm/sec) and the ordinate represents a necessary length of non-print area length (mm).

The CPU 81 carries out a ribbon saving processing of lifting and lowering the thermal head 4 when the length of non-print area in printing data is greater than a given minimum length in a ribbon saving mode. The 'given minimum length', which refers to a length of non-print area necessary for conveying a sheet at a lowest conveyance speed, is a minimum length of non-print area needed for carrying out a ribbon saving processing. The 'given minimum length' is 20 mm in the embodiment.

In a ribbon saving processing, the CPU 81 keeps the thermal head 4 in a head-up state and stops the conveyance of the transfer ribbon 31 during the period in which the part of the non-print area of the label sheet 21 passes through the thermal head 4. In the processing, the CPU 81 keeps the thermal head 4 in a head-down state and restarts the conveyance of the transfer ribbon 31 directly before the part of the printing area of the label sheet 21 reaches the thermal head 4. The CPU 81 restarts the printing when the part of the printing area of the label sheet 21 reaches the thermal head 4. The CPU 81 continuously conveys the label sheet 21 at the printing speed during the processing.

Here, as shown in FIG. 4 and FIG. 5, when the set value of a printing speed (the conveyance speed of the label sheet 21) is 12 mm/sec, the length of non-print area needed in the printing data is 63 mm. Thus, in the past, a ribbon saving processing is unachievable when the length of non-print area in the printing data is below 63 mm, for example, is 40 mm.

Thus, in the embodiment, a table 821, in which conveyance speeds 3, 6, 8, 10, 12 and 14 mm/sec of the label sheet 21 are set corresponding to lengths of non-print area needed for a ribbon saving processing, is stored in the ROM 82. Then, the CPU 81 acquires, from the table 821, a necessary length of non-print area for a set value of printing speed serving as the conveyance speed of the label sheet 21. The CPU 81 lowers the conveyance speed of the label sheet 21 to carry out a ribbon saving processing when the length of non-print area in the printing data is smaller than the necessary length of non-print area but greater than the given minimum length. The aforementioned processing is described in detail below.

The CPU 81 acquires, from the table 821, a necessary length of non-print area of 63 mm for a set value of printing speed of 12 mm/sec (the conveyance speed of the sheet). The CPU 81 sets the conveyance speed of the label sheet 21 in a ribbon saving processing to a speed slower than the set value of printing speed when the length of non-print area in the printing data is, for example, 40 mm, which is below the necessary length of non-print area of 63 mm.

Specifically, the CPU 81 sets the fastest sheet conveyance speed of 8 mm/sec among the sheet conveyance speeds of 3 mm/sec, 6 mm/sec, 8 mm/sec at which a ribbon saving processing is achievable when the length of non-print area in the printing data is 40 mm, as the sheet conveyance speed during a ribbon saving processing in the table 821.

In this way, in the embodiment, a ribbon saving processing is achievable as the conveyance speed of the label sheet 21 can be lowered even if the length of non-print area is not enough for carrying out a ribbon saving processing at the set value of printing speed.

Further, as shown in FIG. 4 and FIG. 5, in the table 821, the higher the sheet conveyance speed is, the greater the increase rate in a necessary length of non-print area length is, and the greater the inclination of the graph showing a sheet conveyance speed and a necessary length of non-print area length is.

Figure 6:
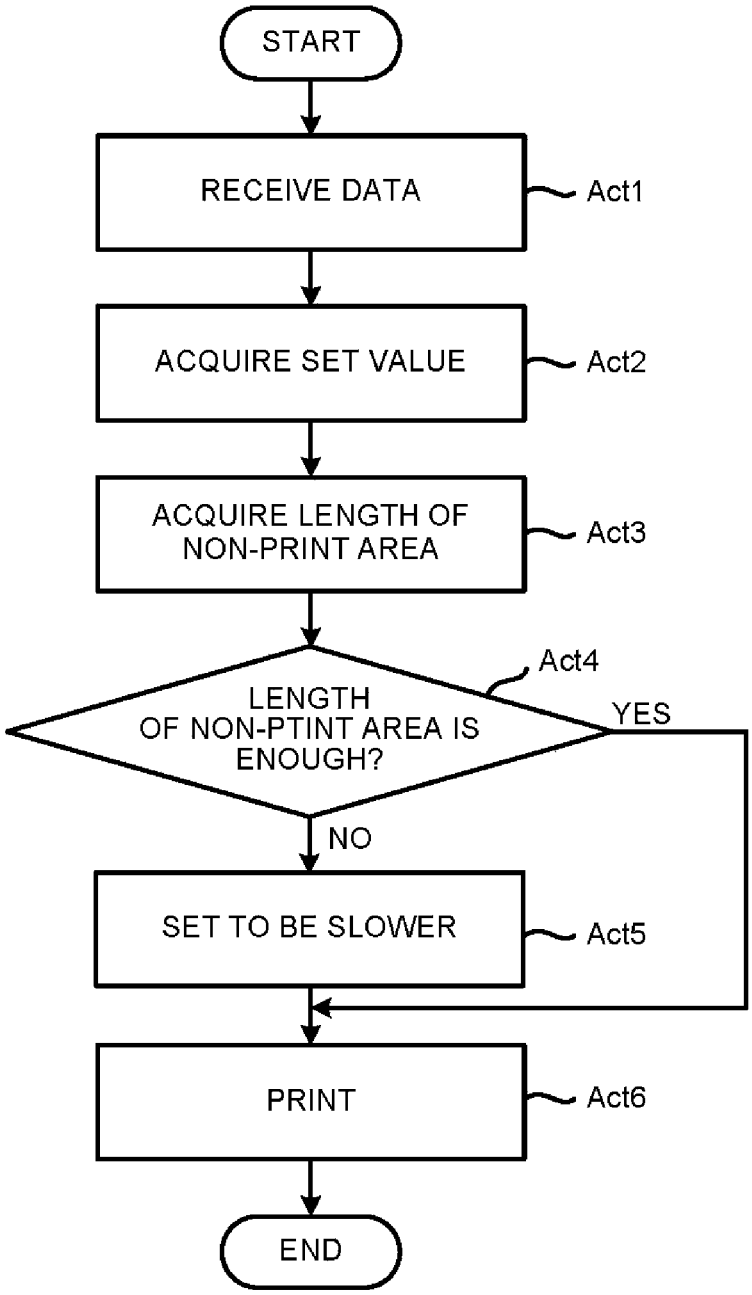
FIG. 6 is a flowchart illustrating a ribbon saving processing.

The processing in a ribbon saving mode according to CPU 81 is described below with reference to the flowchart shown in FIG. 6.

The CPU 81 receives printing data from an external terminal (Act 1).

The CPU 81 sets a printing speed to be a set value of printing speed (e.g. 12 mm/sec) contained in the printing data (Act 2).

The CPU 81 acquires, from the table 821 in the ROM 82, a necessary length of non-print area, e.g. 63 mm, for the set value of printing speed serving as a sheet conveyance speed (Act 3).

If the length of non-print area (e.g. 40 mm) in the printing data is shorter than the necessary length of non-print area (63 mm) but longer than a minimum length (20 mm/sec) necessary for carrying out a ribbon saving processing (NO in Act 4), the CPU 81 carries out a processing as follows.

The CPU 81 sets the fastest sheet conveyance speed (8 mm/sec) among the sheet conveyance speeds (3 mm/sec, 6 mm/sec, 8 mm/sec) at which a ribbon saving processing is achievable with the length of non-print area in the printing data (40 mm), as the set value of the sheet conveyance speed during a ribbon saving processing in the table 821 (Act 5). In this way, the conveyance speed (8 mm/sec) during a ribbon saving processing is set to be slower than a set value of printing speed (12 mm/sec).

The CPU 81 keeps the sheet conveyance speed at the set value of printing speed (12 mm/sec) during the ribbon saving processing if the length of non-print area in the printing data is above the necessary length of non-print area (63 mm) for carrying out a ribbon saving processing at a printing speed of 12 mm/sec.

Figure 7:
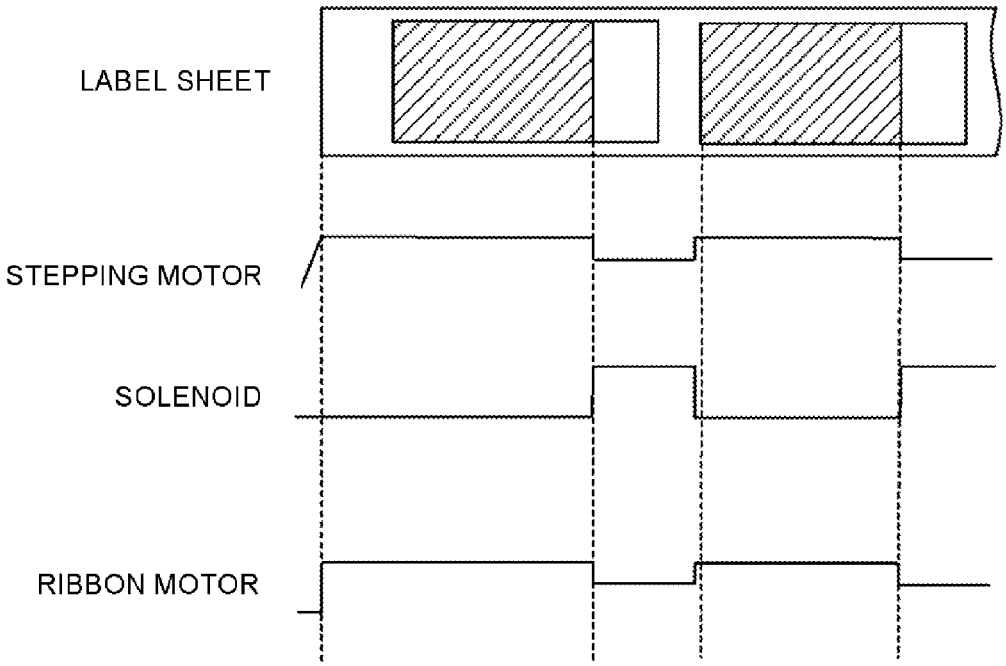
FIG. 7 is a diagram illustrating the timing waveform of each element during a printing process.

FIG. 7 is a diagram illustrating the timing waveform of each element during a printing process.

The CPU 81 carries out printing on the label sheet 21 based on the printing data (Act 6).

Specifically, the CPU 81 prints, with the thermal head 4, on the label sheet 21 through the transfer ribbon 31 while conveying the label sheet 21 along with the transfer ribbon 31 at the printing speed (e.g. 12 mm/sec) acquired in Act2. The CPU 81 turns off the solenoid 73 and keeps the thermal head 4 in a head-down state during a normal printing process.

When the printing in the part of the printing area is ended and the head of the part of the non-print area of the label sheet 21 reaches the printing position of the thermal head 4, the CPU 81 carries out a ribbon saving processing when the length of non-print area is longer than the minimum length necessary for carrying out the ribbon saving processing.

The CPU 81 changes the conveyance speed of the label sheet 21 from the printing speed (e.g. 12 mm/sec) to the slower speed (8 mm/sec) set in Act 5 if the length of non-print area in the printing data is shorter than a length of non-print area (e.g. 63 mm) necessary for the printing speed (e.g. 12 mm/sec). Further, the CPU 81 turns on the solenoid 73, lifts the thermal head 4, stops the driving of the ribbon motors 62 and 64 and stops the conveyance of the transfer ribbon 31. In this way, the CPU 81 lifts the thermal head 4 and conveys the label sheet 21 at the slower conveyance speed (8 mm/sec).

The CPU 81 turns off the solenoid 73 again and lowers the thermal head 4 directly before the head of the part of the printing area of the label sheet 21 reaches the printing position of the thermal head 4. Further, the CPU 81 drives the ribbon motors 62 and 64 to restart the conveyance of the transfer ribbon 31. Then, the CPU 81 carries out printing process again.

Further, the CPU 81 lifts the thermal head 4 while keeping the conveyance speed of the label sheet 21 if the length of non-print area in the printing data is longer than a necessary length of non-print area (e.g. 63 mm) for the printing speed (e.g. 12 mm/sec) and stops the conveyance of transfer ribbon 31. Sequentially, the CPU 81 lowers the thermal head 4 again and restarts the conveyance of the transfer ribbon 31 directly before the part of the printing area of the label sheet 21 reaches the thermal head 4.

The sequence of each processing carried out in the embodiment may be different from the exemplary one.

As stated above in detail, according to the technology disclosed herein, a technology of saving the ribbon of a thermal printer is provided.

While certain embodiments have been described, these embodiments have been presented by way of example only, and are not intended to limit the scope of the invention. Indeed, the novel embodiments described herein may be embodied in a variety of other forms; furthermore, various omissions, substitutions and changes in the form of the embodiments described herein may be made without departing from the spirit of the invention. The accompanying claims and their equivalents are intended to cover such forms or modifications as would fall within the scope and spirit of the invention.

What is claimed is:

1. A thermal printer, comprising:

a thermal head configured to press a transfer ribbon conveyed along with a sheet towards the sheet and endows the transfer ribbon with heat to transfer the ink of the transfer ribbon to the sheet;

a head moving mechanism configured to lift the thermal head to an unprintable position separating from the sheet side and lower the thermal head to a printable position where the transfer ribbon is pressed to the sheet; and a controller configured to acquire a set value of printing speed, carry out printing process while conveying the sheet at the printing speed in a printing area, change the sheet conveyance speed to a speed lower than the set value in a non-print area, and lift and lower the thermal head while conveying the sheet at the lower speed.

2. The apparatus according to claim 1, further comprising: a memory for storing a table in which the sheet conveyance speed is mapped with a length of non-print area necessary for carrying out lifting or lowering the thermal head, wherein the controller acquires, from the table, a necessary length of non-print area for a set value of the printing speed serving as the sheet conveyance speed, and lifts and lowers the thermal head by lowering the sheet conveyance speed if the length of non-print area in printing data is shorter than the necessary length of non-print area but longer than a given minimum length.

3. The apparatus according to claim 2, wherein the controller acquires the fastest sheet conveyance speed in the table among the sheet conveyance speeds at which a lifting and lowering process are achievable with the length of non-print area in the printing data, and lifts and lowers the thermal head while conveying the sheet at the acquired speed.

4. A ribbon saving method for a thermal printer comprising a thermal head configured to press a transfer ribbon conveyed along with a sheet towards the sheet and endow the transfer ribbon with heat to transfer the ink of the transfer ribbon to the sheet; and a head moving mechanism configured to lift the thermal head to an unprintable position separating from the sheet side and lower the thermal head to a printable position where the transfer ribbon is pressed to the sheet, including:

acquiring a set value of a printing speed; and carrying out printing process while conveying the sheet at the printing speed in a printing area, changing the sheet conveyance speed to a speed lower than the set value in a non-print area, and lifting and lowering the thermal head while conveying the sheet at the lower speed.

5. The method according to claim 4, wherein a table is stored in which the sheet conveyance speed is mapped with a necessary length of non-print area for carrying out lifting and lowering the thermal head;

a necessary length of non-print area for the set value of the printing speed serving as the sheet conveyance speed is acquired from the table; and the sheet conveyance speed is lowered to lift and lower the thermal head if the length of non-print area in printing data is shorter than the necessary length of non-print area but longer than the given minimum length.

6. The method according to claim 5, wherein the fastest sheet conveyance speed from the table among the sheet conveyance speeds at which a lifting and lowering process are achievable with the length of non-print area in the printing data is acquired; and the thermal head is lifted and lowered while the sheet is conveyed at the acquired speed.

7. A program enabling a computer to carry out in a thermal printer comprising a thermal head configured to press a transfer ribbon conveyed along with a sheet towards the sheet and endow the transfer ribbon with heat to transfer the ink of the transfer ribbon to the sheet; and a head moving mechanism configured to lift the thermal head to an unprintable position separating from the sheet side and lower the thermal head to a printable position where the transfer ribbon is pressed to the sheet;

including:

acquiring a set value of a printing speed; and carrying out printing process while conveying the sheet at the printing speed in a printing area, changing the sheet conveyance speed to a speed lower than the set value in a non-print area, and lifting and lowering the thermal head while conveying the sheet at the lower speed.

8. The program according to claim 7, enabling a computer to carry out, including:

storing a table in which the sheet conveyance speed is mapped with a necessary length of non-print area for carrying out lifting and lowering the thermal head;

acquiring a necessary length of non-print area for the set value of the printing speed serving as the sheet conveyance speed from the table; and lowering the sheet conveyance speed to lift and lower the thermal head if the length of non-print area in the printing data is shorter than the necessary length of non-print area but longer than the given minimum length.

9. The program according to claim 8, enabling a computer to carry out, including:

acquiring the fastest sheet conveyance speed from the table among the sheet conveyance speeds at which a lifting and lowering process are achievable with the length of non-print area in the printing data; and lifting and lowering the thermal head while the sheet is conveyed at the acquired speed.

* * * * *